US008999011B2

(12) United States Patent
Stern et al.

(10) Patent No.: US 8,999,011 B2
(45) Date of Patent: Apr. 7, 2015

(54) FUEL COMPOSITIONS AND METHODS FOR MAKING SAME

(71) Applicants: David Lawrence Stern, Fairfax, VA (US); Salvatore R. Di Mauro, Fairfax (IT); Aldo Roccaro, Legnano (IT); Paul William Bessonette, Deptford, NJ (US)

(72) Inventors: David Lawrence Stern, Fairfax, VA (US); Salvatore R. Di Mauro, Fairfax (IT); Aldo Roccaro, Legnano (IT); Paul William Bessonette, Deptford, NJ (US)

(73) Assignee: ExxonMobil Research and Engineering Company, Annandal, NJ (US)

( * ) Notice: Subject to any disclaimer, the term of this patent is extended or adjusted under 35 U.S.C. 154(b) by 0 days.

(21) Appl. No.: 13/975,828

(22) Filed: Aug. 26, 2013

(65) Prior Publication Data

US 2013/0340323 A1 Dec. 26, 2013

Related U.S. Application Data

(62) Division of application No. 13/431,050, filed on Mar. 27, 2012.

(60) Provisional application No. 61/468,236, filed on Mar. 28, 2011.

(51) Int. Cl.

| | |
|---|---|
| ***C10L 1/16*** | (2006.01) |
| ***C10G 45/02*** | (2006.01) |
| ***C10L 1/08*** | (2006.01) |

(52) U.S. Cl.

CPC ..... *C10L 1/1616* (2013.01); *C10G 45/02* (2013.01); *C10G 2300/202* (2013.01); *C10G 2300/203* (2013.01); *C10G 2300/207* (2013.01); *C10G 2300/302* (2013.01); *C10G 2300/304* (2013.01); *C10G 2300/308* (2013.01); *C10L 1/08* (2013.01); *C10G 2300/1059* (2013.01); *C10G 2300/208* (2013.01)

(58) Field of Classification Search

CPC ..... C10L 1/16

USPC ..... 44/300, 385, 311, 628; 208/213, 212, 208/211, 214, 215, 216, 217, 218, 15, 347; 585/12, 14

See application file for complete search history.

(56) References Cited

U.S. PATENT DOCUMENTS

| | | | | |
|---|---|---|---|---|
| 3,464,915 | A | 9/1969 | Paterson et al. | |
| 4,006,076 | A | 2/1977 | Christensen et al. | |
| 4,420,388 | A | 12/1983 | Bertolacini et al. | |
| 6,039,771 | A * | 3/2000 | Selvidge et al. | 44/311 |
| 6,103,104 | A | 8/2000 | Gupta | |
| 6,156,695 | A | 12/2000 | Soled et al. | |
| 6,162,350 | A | 12/2000 | Soled et al. | |
| 6,187,174 | B1 | 2/2001 | Morel et al. | |
| 6,299,760 | B1 | 10/2001 | Soled et al. | |
| 6,447,671 | B1 | 9/2002 | Morel et al. | |
| 6,582,590 | B1 | 6/2003 | Riley et al. | |
| 6,719,955 | B1 | 4/2004 | Hwu et al. | |
| 6,783,663 | B1 | 8/2004 | Riley et al. | |
| 6,863,803 | B1 | 3/2005 | Riley et al. | |
| 6,929,738 | B1 | 8/2005 | Riley et al. | |
| 7,229,548 | B2 | 6/2007 | Riley et al. | |
| 7,288,182 | B1 | 10/2007 | Soled et al. | |
| 7,410,924 | B2 | 8/2008 | Corma Canos et al. | |
| 7,544,632 | B2 | 6/2009 | Soled et al. | |
| 7,651,605 | B2 | 1/2010 | Sahara et al. | |
| 7,709,408 | B2 | 5/2010 | Canos et al. | |
| 7,854,834 | B2 | 12/2010 | Corma Canos et al. | |
| 8,216,958 | B2 | 7/2012 | Wu et al. | |
| 8,236,723 | B2 | 8/2012 | Timmer et al. | |
| 8,288,305 | B2 | 10/2012 | Bai et al. | |
| 2005/0277545 | A1 | 12/2005 | Shih et al. | |
| 2006/0060502 | A1 | 3/2006 | Soled et al. | |
| 2007/0084754 | A1 | 4/2007 | Soled et al. | |
| 2007/0240361 | A1 * | 10/2007 | Clayton et al. | 44/385 |
| 2008/0093262 | A1 | 4/2008 | Gragnani et al. | |
| 2008/0132407 | A1 | 6/2008 | Bai et al. | |
| 2009/0158641 | A1 * | 6/2009 | Hayes et al. | 44/309 |
| 2009/0178951 | A1 | 7/2009 | Balthasar et al. | |
| 2009/0321320 | A1 | 12/2009 | Wu et al. | |
| 2011/0139676 | A1 * | 6/2011 | McGehee et al. | 208/15 |

FOREIGN PATENT DOCUMENTS

| | | | |
|---|---|---|---|
| GB | 1209967 | A | 10/1970 |
| JP | 2006000726 | A | 1/2006 |
| RU | 2213125 | C1 | 9/2003 |
| WO | 2009001314 | A1 | 12/2008 |

OTHER PUBLICATIONS

The International Search Report and Written Opinion of PCT/US2012/030788 dated Jul. 13, 2012.

Mitusova et al., "Primary and Secondary Distillates as Marine Fuel Oil", Chemistry and Technology of Fuels and Oils, 2005, pp. 287-291, vol. 41, No. 4, Springer Science+Business Media, Inc.

Derr, Jr. et al., "Moderate Pressure Hydrocracking of Heavy Vacuum Gas Oils", Energy Progress, 1986, pp. 15-19, vol. 6, No. 1.

Koudelka, J. et al., "Technical and Economic Evaluation of Processes for the Production of Low Sulfur Heating Oils", Ropa a Uhlie, 1979, pp. 433-440, vol. 21, No. 8.

Vylkov, P. et al., "New Direction in the Rational Usage of Vacuum Gas Oil", Godishnik na Visshya Khim. heski Institut, Sofiya, 1979, pp. 146-148, vol. 25, No. 2.

"Production, Import, Use, and Disposal," Jun. 21, 2003.

* cited by examiner

*Primary Examiner* — Prem C Singh
*Assistant Examiner* — Chantel Graham
(74) *Attorney, Agent, or Firm* — David M. Weisberg

(57) ABSTRACT

This invention relates to low sulfur marine/bunker fuel compositions and methods of making same. Contrary to conventional marine/bunker fuel compositions/methods, the inventive lower sulfur compositions/methods focus on use of mostly uncracked components, such as (cat feed) hydrotreated gasoils, and/or can also have reduced contents of residual components.

12 Claims, No Drawings

FUEL COMPOSITIONS AND METHODS FOR MAKING SAME

CROSS REFERENCE TO RELATED APPLICATIONS

This Application is a divisional of U.S. application Ser. No. 13/431,050, filed Mar. 27, 2012, which claims the priority of U.S. Provisional Application Ser. No. 61/468,236 filed on Mar. 28, 2011, both of which are herein incorporated by reference in its entirety.

FIELD

This invention relates generally to methods for making marine/bunker fuels having relatively low sulfur content, as well as to the resulting low sulfur content fuel compositions made according to such methods.

BACKGROUND

As promulgated by the International Maritime Organization (IMO), issued as Revised MARPOL Annex VI, marine fuels will be capped globally with increasingly more stringent requirements on sulfur content. In addition, individual countries and regions are beginning to restrict sulfur level used in ships in regions known as Emission Control Areas, or ECAs.

The fuels used in global shipping are typically marine/bunker fuels, for larger ships. Bunker fuels are advantageous since they are less costly than other fuels; however, they are typically composed of cracked and/or resid fuels and hence have higher sulfur levels. Meeting the lower sulfur specs for marine vessels can be conventionally accomplished through the use of distillates. However, distillate fuels typically trade at a high cost premium for a variety of reasons, not the least of which is the utility in a variety of transport applications employing Compression ignition engines. They are produced at low sulfur levels, typically significantly below the sulfur levels specified in the IMO regulations.

Those regulations specify, inter alia, a 1.0 wt % sulfur content on ECA Fuels (effective July, 2010) for residual or distillate fuels, a 3.5 wt % sulfur content cap (effective January, 2012), which can impact about 15% of the current residual fuel supply, a 0.1 wt % sulfur content on ECA Fuels (effective January, 2015), relating mainly to hydrotreated middle distillate fuel, and a 0.5 wt % sulfur content cap (circa 2020-2025), centered mainly on distillate fuel or distillate/residual fuel mixtures. When the ECA sulfur limits and sulfur cap drops, various reactions may take place to supply low sulfur fuels. The 0.1% S ECA fuel can be challenging to supply, since shippers typically purchase lower sulfur fuel oils with properties suitable for marine applications, and at a steep price discount to distillate fuels.

Hydrotreaters in front of FCC units, commonly called CFHT, typically hydroprocess Virgin Gas Oils (VGOs) to sufficiently low sulfur levels such that the product fuels are sufficient to be sold as fuel with no further treatment, or with minimal incremental hydroprocessing.

It would be advantageous to utilize a fuel high energy content, low sulfur fuels in marine applications, which fuels have conventionally included cracked distillates. Distillates can typically command a much higher value than bunker fuels. An alternative low sulfur marine/bunker fuel, with the correct fuel quality characteristics, could command a high premium in the marketplace.

Indeed, there are some publications that disclose the desirability of lowering the sulfur content of marine/bunker fuels.

A non-exclusive list of such publications includes, for example, U.S. Pat. Nos. 4,006,076, 4,420,388, 6,187,174, 6,447,671, and 7,651,605, U.S. Patent Application Publication No. 2008/0093262, PCT Publication Nos. WO 1999/057228 and WO 2009/001314, British Patent No. GB 1209967, Russian Patent No. RU 2213125, Japanese Patent No. JP 2006000726, and the following articles: Chem. & Tech. of Fuels and Oils (2005), 41(4), 287-91; Ropa a Uhlie (1979), 21(8), 433-40; Godishnik na Visshya Khim. heski Institut, Sofiya (1979), 25(2), 146-48; and Energy Progress (1986), 6(1), 15-19.

Thus, it would be desirable to find compositions (and methods for making them) in which hydrotreated and/or uncracked gasoil products could be used in marine/bunker fuels, as described with reference to the invention herein.

SUMMARY OF EMBODIMENTS OF THE INVENTION

One aspect of the invention relates to a method for making a low sulfur marine and/or bunker fuel composition with a reduced concentration of components that have been cracked, the method comprising: contacting a gasoil feed stream having at least 2000 wppm, for example at least 7500 wppm, sulfur content with a hydrogen-containing gas in the presence of a hydrotreating catalyst under effective hydrotreating conditions in a catalytic feed hydrotreater, such that the product exhibits at most 5000 wppm, for example at most 1000 wppm, sulfur content, a pour point of at least 7° C., and a kinematic viscosity of at least 12 cSt at about 50° C., without the product being subject to cracking; optionally blending at least a portion of the uncracked product with 0-70 vol % of other components, selected from viscosity modifiers, pour point depressants, lubricity modifiers, antioxidants, and combinations thereof, to form a marine and/or bunker fuel composition, the resulting marine and/or bunker fuel composition containing the uncracked product having: at most 5000 wppm, for example at most 1000 wppm, sulfur content; at most 25 vol %, based on all components of the marine and/or bunker fuel composition, of residual components selected from crude fractionation vacuum resid, crude fractionation atmospheric resid, visbreaker resid, deasphalted vacuum resid, slurry oil, and combinations thereof; less than 50 vol %, based on all components of the marine and/or bunker fuel composition, of residual components, components subject to a refinery cracking step, or both; and at least one of a kinematic viscosity at about 50° C. from 12 cSt to 50 cSt, a density at about 15° C. from 0.90 g/cm$^3$ to 0.94 g/cm$^3$, a pour point from 7° C. to 45° C., and a calculated carbon aromaticity index of 850 or less.

Another aspect of the invention relates to a low sulfur marine and/or bunker fuel composition comprising: 30 vol % to 100 vol % of an uncracked, hydrotreated gasoil product having at most 5000 wppm, for example at most 1000 wppm, sulfur content, a pour point of at least 7° C., and a kinematic viscosity of at least 12 cSt at about 50° C.; and up to 70 vol % of other components, selected from viscosity modifiers, pour point depressants, lubricity modifiers, antioxidants, and combinations thereof, wherein the low sulfur marine and/or bunker fuel composition has: at most 5000 wppm, for example at most 1000 wppm, sulfur content; at most 25 vol %, based on all components of the marine and/or bunker fuel composition, of residual components selected from crude fractionation vacuum resid, crude fractionation atmospheric resid, visbreaker resid, deasphalted vacuum resid, slurry oil, and combinations thereof; less than 50 vol %, based on all components of the marine and/or bunker fuel composition, of residual components, components subject to a refinery cracking step, or both; and at least one of a kinematic viscosity at about 50° C. from 12 cSt to 50 cSt, a density at about 15° C. from 0.90 g/cm$^3$ to 0.94 g/cm$^3$, a pour point from 7° C. to 45° C., and a calculated carbon aromaticity index of 850 or less.

DETAILED DESCRIPTION OF THE EMBODIMENTS

In one aspect of the invention, a method is described for making a low sulfur marine and/or bunker fuel composition, while another aspect of the invention describes the low sulfur marine and/or bunker fuel composition so made. In either aspect, the low sulfur fuel composition can advantageously meet a stricter standard than currently required for marine and bunker fuels by having a maximum sulfur content of 5000 wppm, or more restrictively 1000 wppm. Although sulfur content standards for fuels are not generally given a minimum, it can often be desirable to be as close to the standard maximum as possible for any number of reasons, which may include, without limitation, that stringent sulfur standards requiring additional costly treatment can be reduced/minimized by allowing relatively high-sulfur, relatively low-value streams to be incorporated into compositions where they otherwise might not negatively affect the specifications. As such, in many embodiments meeting the more restrictive 1000 wppm specification, the low sulfur marine and/or bunker fuels, e.g., made according to the methods disclosed herein, can exhibit a sulfur content between 900 wppm and 1000 wppm. Nevertheless, in other embodiments meeting the more restrictive 1000 wppm specification, the low sulfur marine and/or bunker fuels, e.g., made according to the methods disclosed herein, can exhibit a sulfur content of at most 850 wppm, for example at most 750 wppm, at most 700 wppm, at most 650 wppm, at most 600 wppm, at most 550 wppm, at most 500 wppm, at most 450 wppm, at most 400 wppm, at most 350 wppm, at most 300 wppm, at most 250 wppm, at most 200 wppm, at most 150 wppm, at most 100 wppm, at most 75 wppm, at most 50 wppm, at most 30 wppm, at most 20 wppm, at most 15 wppm, at most 10 wppm, at most 8 wppm, or at most 5 wppm. Further, in other embodiments meeting the 5000 wppm specification, the low sulfur marine and/or bunker fuels, e.g., made according to the methods disclosed herein, can exhibit a sulfur content of at most 4900 wppm, for example at most 4800 wppm, at most 4700 wppm, at most 4600 wppm, at most 4500 wppm, at most 4400 wppm, at most 4300 wppm, at most 4200 wppm, at most 4100 wppm, at most 4000 wppm, at most 3750 wppm, at most 3500 wppm, at most 3250 wppm, at most 3000 wppm, at most 2750 wppm, at most 2500 wppm, at most 2250 wppm, at most 2000 wppm, at most 1750 wppm, at most 1500 wppm, at most 1250 wppm, at most 1000 wppm, at most 750 wppm, at most 500 wppm, at most 250 wppm, at most 100 wppm, at most 75 wppm, at most 50 wppm, at most 30 wppm, at most 20 wppm, at most 15 wppm, at most 10 wppm, at most 8 wppm, or at most 5 wppm. In such various other embodiments, the low sulfur marine and/or bunker fuels, e.g., made according to the methods disclosed herein, may additionally exhibit a sulfur content of at least 5 wppm, for example at least 10 wppm, at least 15 wppm, at least 20 wppm, at least 30 wppm, at least 50 wppm, at least 75 wppm, at least 100 wppm, at least 150 wppm, at least 200 wppm, at least 250 wppm, at least 300 wppm, at least 350 wppm, at least 400 wppm, at least 450 wppm, at least 500 wppm, at least 550 wppm, at least 600 wppm, at least 650 wppm, at least 700 wppm, at least 750 wppm, at least 800 wppm, at least 850 wppm, at least 900 wppm, at least 950 wppm, at least 1000 wppm, at least 1250 wppm, at least 1500 wppm, at least 1750 wppm, at least 2000 wppm, at least 2250 wppm, at least 2500 wppm, at least 2750 wppm, at least 3000 wppm, at least 3250 wppm, at least 3500 wppm, at least 3750 wppm, at least 4000 wppm, at least 4100 wppm, at least 4200 wppm, at least 4300 wppm, at least 4400 wppm, at least 4500 wppm, at least 4600 wppm, at least 4700 wppm, at least 4800 wppm, or at least 4900 wppm.

Advantageously, and contrary to conventional practices, the present compositions and methods focus on a reduced use/concentration of components that have been subject to a (refinery) cracking process. This should be understood to include steps/stages whose primary or significant focus is cracking (e.g., FCC processes, steam cracking processes, thermal cracking processes such as visbreaking and/or coking, and the like, but typically not hydrocracking), but not to include steps/stages where cracking is a very minor focus or a side reaction (e.g., hydrotreating processes, aromatic saturation processes, hydrofinishing processes, and the like). Without being bound by theory, it is believed that reducing the amount of cracked stocks in a fuel composition can have an advantage of improving oxidation stability and/or ignition quality of the fuel composition (e.g., hydrocracked stocks can tend to be differentiatable from other cracked stocks in that their quality, such as in oxidation stability and/or ignition quality, can tend to be acceptable or even relatively high, perhaps due to the role that hydrogen plays in such cracking processes). As a result, conventional cracked components of marine/bunker fuels such as cycle oils (e.g., light and heavy), slurry oils (i.e., the FCC bottoms), and the like, can advantageously be reduced/minimized or at least kept to a relatively low level.

Further additionally or alternately, the present compositions and methods can focus on a reduced use/concentration of residual components. Examples of such residual components can include, but are not limited to, vacuum resid from fractionating (total/partial) crude oils, atmospheric resid from fractionating (total/partial) crude oils, visbreaker resid, deasphalted vacuum resid, slurry oil, and the like, and combinations thereof. Without being bound by theory, it is believed that reducing the amount of residual components in a fuel composition can have an advantage of reducing metals content(s) and/or content of catalyst fines in the fuel composition. As a result, such residual components of marine/bunker fuels can advantageously be reduced/minimized or at least kept to a relatively low level.

For example, in many embodiments, the content of residual components can be at most 25 vol %, based on all components of the marine and/or bunker fuel composition, for example at most 20 vol %, at most 15 vol %, at most 10 vol %, at most 5 vol %, at most 3 vol %, at most 1 vol %, at most 0.5 vol %, at most 0.1 vol %, or substantially none. Additionally or alternately, in many embodiments, the total content of residual and cracked components can be less than 50 vol %, based on all components of the marine and/or bunker fuel composition, for example at most 45 vol %, at most 40 vol %, at most 35 vol %, at most 30 vol %, at most 25 vol %, at most 20 vol %, at most 15 vol %, at most 10 vol %, at most 5 vol %, at most 3 vol %, at most 1 vol %, at most 0.5 vol %, at most 0.1 vol %, or substantially none. Further additionally or alternately, in some embodiments, the content of cracked components can be at most 35 vol %, based on all components of the marine and/or bunker fuel composition, for example at most 30 vol %, at most 25 vol %, at most 20 vol %, at most 15 vol %, at most 10 vol %, at most 5 vol %, at most 3 vol %, at most 1 vol %, at most 0.5 vol %, at most 0.1 vol %, or substantially none.

Still further additionally or alternately, the low sulfur marine and/or bunker fuels, e.g., made according to the methods disclosed herein, can exhibit at least one of the following characteristics: a kinematic viscosity at about 50° C. (according to standardized test method ISO 3104) of at least 12 cSt, for example at least 15 cSt, at least 20 cSt, at least 25 cSt, at least 30 cSt, at least 35 cSt, at least 40 cSt, or at least 45 cSt; a kinematic viscosity at about 50° C. (according to standardized test method ISO 3104) of at most 55 cSt, for example at most 50 cSt, at most 45 cSt, at most 40 cSt, at most 35 cSt, at most 30 cSt, at most 25 cSt, at most 20 cSt, at most 15 cSt, or at most 12 cSt; a density at about 15° C. (according to standardized test method ISO 3675 or ISO 12185) of at most 0.940 g/cm$^3$, for example at most 0.935 g/cm$^3$, at most 0.930 g/cm$^3$, at most 0.925 g/cm$^3$, at most 0.920 g/cm$^3$, at most 0.915 g/cm$^3$, at most 0.910 g/cm$^3$, at most 0.905 g/cm$^3$, at most 0.900 g/cm$^3$, at most 0.895 g/cm$^3$, at most 0.890 g/cm$^3$, at most 0.885 g/cm$^3$, or at most 0.880 g/cm$^3$; a density at about 15° C. (according to standardized test method ISO 3675 or ISO 12185) of at least 0.870 g/cm$^3$, at least 0.875 g/cm$^3$, at least 0.880 g/cm$^3$, at least 0.885 g/cm$^3$, at least 0.890 g/cm$^3$, at least 0.895 g/cm$^3$, at least 0.900 g/cm$^3$, at least 0.905 g/cm$^3$, at least 0.910 g/cm$^3$, at least 0.915 g/cm$^3$, at least 0.920 g/cm$^3$, at least 0.925 g/cm$^3$, at least 0.930 g/cm$^3$, or at least 0.935 g/cm$^3$; a pour point (according to standardized test method ISO 3016) of at most 45° C., for example at most 40° C., at most 35° C., at most 30° C., at most 25° C., at most 20° C., at most 15° C., at most 10° C., at most 6° C., at most 5° C., or at most 0° C.; a pour point (according to standardized test method ISO 3016) of at least −50° C., for example at least −35° C., at least −30° C., at least −25° C., at least −20° C., at least −15° C., at least −10° C., at least −5° C., at least 0° C., at least 5° C., at least 7° C., at least 10° C., at least 15° C., at least 20° C., at least 25° C., at least 30° C., at least 35° C., or at least 40° C.; a calculated carbon aromaticity index (according to standardized test method ISO 8217 Annex F, including Equation F.1) of 880 or less, for example 865 or less, 850 or less, 840 or less, 830 or less, 820 or less, 810 or less, or 800 or less; and a calculated carbon aromaticity index (according to standardized test method ISO 8217 Annex F, including Equation F.1) of 780 or more, for example 800 or more, 810 or more, 820 or more, 830 or more, 840 or more, 850 or more, 860 or more, 870 or more, or 880 or more.

Yet still further additionally or alternately, the low sulfur marine and/or bunker fuels, e.g., made according to the methods disclosed herein, can exhibit at least one of the following characteristics: a flash point (according to standardized test method ISO 2719) of at least 60° C.; a hydrogen sulfide content (according to standardized test method IP 570) of at most 2.0 mg/kg; an acid number (according to standardized test method ASTM D-664) of at most 0.5 mg KOH per gram; a sediment content (according to standardized test method ISO 10307-1) of at most 0.1 wt %; an oxidation stability (measured by ageing under same conditions as standardized test method ISO 12205, followed by filtration according to standard test method ISO 10307-1) of at most 0.10 mass %; a water content (according to standardized test method ISO 3733) of at most 0.3 vol %; and an ash content (according to standardized test method ISO 6245) of at most 0.01 wt %.

One important component of the low sulfur marine and/or bunker fuel compositions according to the invention and/or made according to the methods disclosed herein is an uncracked, hydrotreated gasoil product, which represents a gasoil feed stream (e.g., a vacuum gasoil) that has been (cat feed) hydrotreated through contact with a hydrogen-containing gas in the presence of a hydrotreating catalyst under effective hydrotreating conditions (in a catalytic feed hydrotreater reactor). This uncracked, hydrotreated gasoil product is generally the effluent from a cat feed hydrotreater (CFHT), before being sent to a refinery cracking unit (such as an FCC unit). In the present invention, the low sulfur marine and/or bunker fuel composition, e.g., made according to the methods disclosed herein, can be comprised of at least 30 vol % of this uncracked, hydrotreated gasoil product, for example at least 40 vol %, at least 50 vol %, at least 60 vol %, at least 70 vol %, at least 80 vol %, at least 85 vol %, at least 90 vol %, at least 95 vol %, at least 97 vol %, at least 98 vol %, at least 99 vol %, at least 99.9 vol %, or at least 99.99 vol %. Additionally or alternately, the low sulfur marine and/or bunker fuel composition, e.g., made according to the methods disclosed herein, can be comprised of 100 vol % or less of this uncracked, hydrotreated gasoil product, for example at most 99.99 vol %, at most 99.9 vol %, at most 99 vol %, at most 98 vol %, at most 97 vol %, at most 95 vol %, at most 90 vol %, at most 85 vol %, at most 80 vol %, at most 70 vol %, at most 60 vol %, at most 50 vol %, or at most 40 vol %.

Prior to being hydrotreated, the gasoil feed stream (e.g., a vacuum gasoil feed stream) can generally have a sulfur content significantly higher than post-hydrotreatment. For instance, the pre-hydrotreated gasoil feed stream can have a sulfur content of at least 2000 wppm, for example at least 3000 wppm, at least 5000 wppm, at least 7500 wppm, at least 1 wt %, at least 1.5 wt %, at least 2 wt %, at least 2.5 wt %, or at least 3 wt %.

After being hydrotreated and without being subject to a (refinery) cracking step, the uncracked, hydrotreated gasoil product can exhibit at least one of the following characteristics: a sulfur content of at most 5000 wppm, for example at most 4900 wppm, for example at most 4800 wppm, at most 4700 wppm, at most 4600 wppm, at most 4500 wppm, at most 4400 wppm, at most 4300 wppm, at most 4200 wppm, at most 4100 wppm, at most 4000 wppm, at most 3750 wppm, at most 3500 wppm, at most 3250 wppm, at most 3000 wppm, at most 2750 wppm, at most 2500 wppm, at most 2250 wppm, at most 2000 wppm, at most 1750 wppm, at most 1500 wppm, at most 1250 wppm, at most 1000 wppm, at most 900 wppm, at most 800 wppm, at most 750 wppm, at most 700 wppm, at most 650 wppm, at most 600 wppm, at most 550 wppm, at most 500 wppm, at most 450 wppm, at most 400 wppm, at most 350 wppm, at most 300 wppm, at most 250 wppm, at most 200 wppm, at most 150 wppm, at most 100 wppm, at most 75 wppm, at most 50 wppm, at most 30 wppm, at most 20 wppm, at most 15 wppm, at most 10 wppm, at most 8 wppm, or at most 5 wppm; a sulfur content of at least 5 wppm, for example at least 10 wppm, at least 15 wppm, at least 20 wppm, at least 30 wppm, at least 50 wppm, at least 75 wppm, at least 100 wppm, at least 150 wppm, at least 200 wppm, at least 250 wppm, at least 300 wppm, at least 350 wppm, at least 400 wppm, at least 450 wppm, at least 500 wppm, at least 550 wppm, at least 600 wppm, at least 650 wppm, at least 700 wppm, at least 750 wppm, at least 800 wppm, at least 850 wppm, at least 900 wppm, at least 950 wppm, at least 1000 wppm, at least 1250 wppm, at least 1500 wppm, at least 1750 wppm, at least 2000 wppm, at least 2250 wppm, at least 2500 wppm, at least 2750 wppm, at least 3000 wppm, at least 3250 wppm, at least 3500 wppm, at least 3750 wppm, at least 4000 wppm, at least 4100 wppm, at least 4200 wppm, at least 4300 wppm, at least 4400 wppm, at least 4500 wppm, at least 4600 wppm, at least 4700 wppm, at least 4800 wppm, or at least 4900 wppm; a kinematic viscosity at about 50° C. (according to standardized test method ISO 3104) of at least 12 cSt, for example at least 15 cSt, at least 20 cSt, at least 25 cSt, at least 30 cSt, at least 35 cSt, at least 40 cSt, or at least 45 cSt; a kinematic viscosity at about 50° C. (according to standardized test method ISO 3104) of at most 55 cSt, for example at most 50 cSt, at most 45 cSt, at most 40 cSt, at most 35 cSt, at most 30 cSt, at most 25 cSt, at most 20 cSt, at most 15 cSt, or at most 12 cSt; a density at about 15° C. (according to standardized test method ISO 3675 or ISO 12185) of at most 0.940 g/cm$^3$, for example at most 0.935 g/cm$^3$, at most 0.930 g/cm$^3$, at most 0.925 g/cm$^3$, at most 0.920 g/cm$^3$, at most 0.915 g/cm$^3$, at most 0.910 g/cm$^3$, at most 0.905 g/cm$^3$, at most 0.900 g/cm$^3$, at most 0.895 g/cm$^3$, at most 0.890 g/cm$^3$, at most 0.885 g/cm$^3$, or at most 0.880 g/cm$^3$; a density at about 15° C. (according to standardized test method ISO 3675 or ISO 12185) of at least 0.870 g/cm$^3$, at least 0.875 g/cm$^3$, at least 0.880 g/cm$^3$, at least 0.885 g/cm$^3$, at least 0.890 g/cm$^3$, at least 0.895 g/cm$^3$, at least 0.900 g/cm$^3$, at least 0.905 g/cm$^3$, at least 0.910 g/cm$^3$, at least 0.915 g/cm$^3$, at least 0.920 g/cm$^3$, at least 0.925 g/cm$^3$, at least 0.930 g/cm$^3$, or at least 0.935 g/cm$^3$; a pour point (according to standardized test method ISO 3016) of at most 45° C., for example at most 40° C., at most 35° C., at most 30° C., at most 25° C., at most 20° C., at most 15° C., at most 10° C., at most 6° C., at most 5° C., or at most 0° C.; a pour point (according to standardized test method ISO 3016) of at least −50° C., for example at least −35° C., at least −30° C., at least −25° C., at least −20° C., at least −15° C., at least −10° C., at least −5° C., at least 0° C., at least 5° C., at least 7° C., at least 10° C., at least 15° C., at least 20° C., at least 25° C., at least 30° C., at least 35° C., or at least 40° C.; a calculated carbon aromaticity index (according to standardized test method ISO 8217 Annex F, including Equation F.1) of 880 or less, for example 865 or less, 850 or less, 840 or less, 830 or less, 820 or less, 810 or less, or 800 or less; and a calculated carbon aromaticity index (according to standardized test method ISO 8217 Annex F, including Equation F.1) of 780 or more, for example 800 or more, 810 or more, 820 or more, 830 or more, 840 or more, 850 or more, 860 or more, 870 or more, or 880 or more.

After being hydrotreated and without being subject to a (refinery) cracking step, the uncracked, hydrotreated gasoil product can optionally also exhibit at least one of the following boiling point characteristics: an initial boiling point (IBP) of at least 230° C., for example at least 235° C., at least 240° C., at least 245° C., at least 250° C., at least 255° C., at least 260° C., at least 265° C., at least 270° C., at least 275° C., or at least 280° C.; an IBP of at most 285° C., for example at most 280° C., at most 275° C., at most 270° C., at most 265° C., at most 260° C., at most 255° C., at most 250° C., at most 245° C., at most 240° C., or at most 235° C.; a T5 boiling point of at least 280° C., for example at least 285° C., at least 290° C., at least 295° C., at least 300° C., at least 305° C., at least 310° C., at least 315° C., at least 320° C., at least 325° C., at least 330° C., at least 335° C., at least 340° C., at least 345° C., or at least 350° C.; a T5 boiling point of at most 355° C., for example at most 350° C., at most 345° C., at most 340° C., at most 335° C., at most 330° C., at most 325° C., at most 320° C., at most 315° C., at most 310° C., at most 305° C., at most 300° C., at most 295° C., at most 290° C., or at most 285° C.; a T50 boiling point of at least 400° C., for example at least 405° C., at least 410° C., at least 415° C., at least 420° C., at least 425° C., at least 430° C., at least 435° C., at least 440° C., at least 445° C., at least 450° C., at least 455° C., at least 460° C., at least 465° C., or at least 470° C.; a T50 boiling point of at most 475° C., for example at most 470° C., at most 465° C., at most 460° C., at most 455° C., at most 450° C., at most 445° C., at most 440° C., at most 435° C., at most 430° C., at most 425° C., at most 420° C., at most 415° C., at most 410° C., or at most 405° C.; a T95 boiling point of at least 510° C., for example at least 515° C., at least 520° C., at least 525° C., at least 530° C., at least 535° C., at least 540° C., at least 545° C., at least 550° C., at least 555° C., at least 560° C., at least 565° C., at least 570° C., at least 575° C., at least 580° C., at least 585° C., or at least 590° C.; a T95 boiling point of at most 595° C., for example at most 590° C., at most 585° C., at most 580° C., at most 575° C., at most 570° C., at most 565° C., at most 560° C., at most 555° C., at most 550° C., at most 545° C., at most 540° C., at most 535° C., at most 530° C., at most 525° C., at most 520° C., or at most 515° C.; a final boiling point (FBP) of at least 560° C., for example at least 565° C., at least 570° C., at least 575° C., at least 580° C., at least 585° C., at least 590° C., at least 595° C., at least 600° C., at least 605° C., at least 610° C., at least 615° C., at least 620° C., at least 625° C., at least 630° C., at least 635° C., or at least 640° C.; and an FBP of at most 645° C., for example at most 640° C., at most 635° C., at most 630° C., at most 625° C., at most 620° C., at most 615° C., at most 610° C., at most 605° C., at most 600° C., at most 595° C., at most 590° C., at most 585° C., at most 580° C., at most 575° C., at most 570° C., or at most 565° C. As used herein, a "T[num]" boiling point of a composition represents the temperature required to boil at least [num] percent by weight of that composition. For example, the temperature required to boil at least 25 wt % of a feed is referred to herein as a "T25" boiling point. The basic test method of determining the boiling points or ranges of any feedstock, any fuel component, and/or any fuel composition produced according to this invention, can be performed according to standardized test method IP 480 and/or by batch distillation according to ASTM D86-09e1.

Optionally in some embodiments, the uncracked, hydrotreated gasoil product can additionally exhibit at least one of the following characteristics: a flash point (according to standardized test method ISO 2719) of at least 60° C.; a hydrogen sulfide content (according to standardized test method IP 570) of at most 2.0 mg/kg; an acid number (according to standardized test method ASTM D-664) of at most 0.5 mg KOH per gram; a sediment content (according to standardized test method ISO 10307-1) of at most 0.1 wt %; an oxidation stability (measured by ageing under same conditions as standardized test method ISO 12205, followed by filtration according to standard test method ISO 10307-1) of at most 0.10 mass %; a water content (according to standardized test method ISO 3733) of at most 0.3 vol %; and an ash content (according to standardized test method ISO 6245) of at most 0.01 wt %.

When there are other components in the low sulfur marine and/or bunker fuel composition, e.g., made according to the methods disclosed herein, aside from the uncracked, hydrotreated gasoil product, there can be up to 70 vol % of other components, individually or in total, for example up to 65 vol %, up to 60 vol %, up to 55 vol %, up to 50 vol %, up to 45 vol %, up to 40 vol %, up to 35 vol %, up to 30 vol %, up to 25 vol %, up to 20 vol %, up to 15 vol %, up to 10 vol %, up to 7.5 vol %, up to 5 vol %, up to 3 vol %, up to 2 vol %, up to 1 vol %, up to 0.8 vol %, up to 0.5 vol %, up to 0.3 vol %, up to 0.2 vol %, up to 1000 vppm, up to 750 vppm, up to 500 vppm, up to 300 vppm, or up to 100 vppm. Additionally or alternately when there are other components in the low sulfur marine and/or bunker fuel, e.g., made according to the methods disclosed herein, aside from the uncracked, hydrotreated gasoil product, there can be at least 100 vppm of other components, individually or in total, for example at least 300 vppm, at least 500 vppm, at least 750 vppm, at least 1000 vppm, at least 0.2 vol %, at least 0.3 vol %, at least 0.5 vol %, at least 0.8 vol %, at least 1 vol %, at least 2 vol %, at least 3 vol %, at least 5 vol %, at least 7.5 vol %, at least 10 vol %, at least 15 vol %, at least 20 vol %, at least 25 vol %, at least 30 vol %, at least 35 vol %, at least 40 vol %, at least 45 vol %, at least 50 vol %, at least 55 vol %, at least 60 vol %, or at least 65 vol %. Examples of such other components can include, but are not limited to, viscosity modifiers, pour point depressants, lubricity modifiers, antioxidants, and combinations thereof. Other examples of such other components can include, but are not limited to, distillate boiling range components such as straight-run atmospheric (fractionated) distillate streams, straight-run vacuum (fractionated) distillate streams, hydrocracked distillate streams, and the like, and combinations thereof. Such distillate boiling range components can behave as viscosity modifiers, as pour point depressants, as lubricity modifiers, as some combination thereof, or even in some other functional capacity in the aforementioned low sulfur marine/bunker fuel.

Examples of pour point depressants can include, but are not limited to, oligomers/copolymers of ethylene and one or more comonomers (such as those commercially available from Infineum, e.g., of Linden, N.J.), which may optionally be modified post-polymerization to be at least partially functionalized (e.g., to exhibit oxygen-containing and/or nitrogen-containing functional groups not native to each respective comonomer). Depending upon the physico-chemical nature of the uncracked, hydrotreated gasoil product and/or the low sulfur marine and/or bunker fuel composition, e.g., made according to the methods disclosed herein, in some embodiments, the oligomers/copolymers can have a number average molecular weight (Mn) of about 500 g/mol or greater, for example about 750 g/mol or greater, about 1000 g/mol or greater, about 1500 g/mol or greater, about 2000 g/mol or greater, about 2500 g/mol or greater, about 3000 g/mol or greater, about 4000 g/mol or greater, about 5000 g/mol or greater, about 7500 g/mol or greater, or about 10000 g/mol or greater. Additionally or alternately in such embodiments, the oligomers/copolymers can have a number average molecular weight (Mn) of about 25000 g/mol or less, for example about 20000 g/mol or less, about 15000 g/mol or less, about 10000 g/mol or less, about 7500 g/mol or less, about 5000 g/mol or less, about 4000 g/mol or less, about 3000 g/mol or less, about 2500 g/mol or less, about 2000 g/mol or less, about 1500 g/mol or less, or about 1000 g/mol or less. The amount of pour point depressants, when desired to be added to the low sulfur marine and/or bunker fuel composition, e.g., made according to the methods disclosed herein, can include any amount effective to reduce the pour point to a desired level, such as within the general ranges described hereinabove.

In some embodiments, in addition to an uncracked, hydrotreated gasoil product, the low sulfur marine and/or bunker fuel, e.g., made according to the methods disclosed herein, can comprise up to 15 vol % (for example, up to 10 vol %, up to 7.5 vol %, or up to 5 vol %; additionally or alternately, at least 1 vol %, for example at least 3 vol %, at least 5 vol %, at least 7.5 vol %, or at least 10 vol %) of slurry oil, fractionated (but otherwise untreated) crude oil, or a combination thereof.

The (cat feed) hydrotreatment of the gasoil feed stream to attain the uncracked, hydrotreated gasoil product can be accomplished in any suitable reactor or combination of reactors in a single stage or in multiple stages. This hydrotreatment step typically includes exposure of the feed stream to a hydrotreating catalyst under effective hydrotreating conditions. The hydrotreating catalyst can comprise any suitable hydrotreating catalyst, e.g., a catalyst comprising at least one Group VIII metal (for example selected from Ni, Co, and a combination thereof) and at least one Group VIB metal (for example selected from Mo, W, and a combination thereof), optionally including a suitable support and/or filler material (e.g., comprising alumina, silica, titania, zirconia, or a combination thereof). The hydrotreating catalyst according to aspects of this invention can be a bulk catalyst or a supported catalyst. Techniques for producing supported catalysts are well known in the art. Techniques for producing bulk metal catalyst particles are known and have been previously described, for example in U.S. Pat. No. 6,162,350, which is hereby incorporated by reference. Bulk metal catalyst particles can be made via methods where all of the metal catalyst precursors are in solution, or via methods where at least one of the precursors is in at least partly in solid form, optionally but preferably while at least another one of the precursors is provided only in a solution form. Providing a metal precursor at least partly in solid form can be achieved, for example, by providing a solution of the metal precursor that also includes solid and/or precipitated metal in the solution, such as in the form of suspended particles. By way of illustration, some examples of suitable hydrotreating catalysts are described in one or more of U.S. Pat. Nos. 6,156,695, 6,162,350, 6,299,760, 6,582,590, 6,712,955, 6,783,663, 6,863,803, 6,929,738, 7,229,548, 7,288,182, 7,410,924, and 7,544,632, U.S. Patent Application Publication Nos. 2005/0277545, 2006/0060502, 2007/0084754, and 2008/0132407, and International Publication Nos. WO 04/007646, WO 2007/084437, WO 2007/084438, WO 2007/084439, and WO 2007/084471, inter alia.

The catalysts in the hydrotreating step(s) according to the invention may optionally contain additional components, such as other transition metals (e.g., Group V metals such as niobium), rare earth metals, organic ligands (e.g., as added or as precursors left over from oxidation and/or sulfidization steps), phosphorus compounds, boron compounds, fluorine-containing compounds, silicon-containing compounds, promoters, binders, fillers, or like agents, or combinations thereof. The Groups referred to herein reference Groups of the CAS Version as found in the Periodic Table of the Elements in Hawley's Condensed Chemical Dictionary, 13$^{th}$ Edition.

In some embodiments, the effective hydrotreating conditions can comprise one or more of: a weight average bed temperature (WABT) from about 550° F. (about 288° C.) to about 800° F. (about 427° C.); a total pressure from about 300 psig (about 2.1 MPag) to about 3000 psig (about 20.7 MPag), for example from about 700 psig (about 4.8 MPag) to about 2000 psig (about 13.8 MPag); an LHSV from about 0.1 $hr^{-1}$ to about 20 $hr^{-1}$, for example from about 0.2 $hr^{-1}$ to about 10 $hr^{-1}$; and a hydrogen treat gas rate from about 500 scf/bbl (about 85 $Nm^3/m^3$) to about 10000 scf/bbl (about 1700 $Nm^3/m^3$), for example from about 750 scf/bbl (about 130 $Nm^3/m^3$) to about 7000 scf/bbl (about 1200 $Nm^3/m^3$) or from about 1000 scf/bbl (about 170 $Nm^3/m^3$) to about 5000 scf/bbl (about 850 $Nm^3/m^3$).

Hydrogen-containing (treat) gas, as referred to herein, can be either pure hydrogen or a gas containing hydrogen, in an amount at least sufficient for the intended reaction purpose(s), optionally in addition to one or more other gases (e.g., nitrogen, light hydrocarbons such as methane, and the like, and combinations thereof) that generally do not adversely interfere with or affect either the reactions or the products. Impurities, such as $H_2S$ and $NH_3$, are typically undesirable and would typically be removed from, or reduced to desirably low levels in, the treat gas before it is conducted to the reactor stage(s). The treat gas stream introduced into a reaction stage can preferably contain at least about 50 vol % hydrogen, for example at least about 75 vol %, at least about 80 vol %, at least about 85 vol %, or at least about 90 vol %.

The feedstock provided to the hydrotreating step according to the invention can, in some embodiments, comprise both a gasoil feed portion and a biofeed (lipid material) portion. In one embodiment, the lipid material and gasoil feed can be mixed together prior to the hydrotreating step. In another embodiment, the lipid material and gasoil feed can be provided as separate streams into one or more appropriate reactors.

The term "lipid material" as used according to the invention is a composition comprised of biological materials. Generally, these biological materials include vegetable fats/oils, animal fats/oils, fish oils, pyrolysis oils, and algae lipids/oils, as well as components of such materials. More specifically, the lipid material includes one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

Major classes of lipids include, but are not necessarily limited to, fatty acids, glycerol-derived lipids (including fats, oils and phospholipids), sphingosine-derived lipids (including ceramides, cerebrosides, gangliosides, and sphingomyelins), steroids and their derivatives, terpenes and their derivatives, fat-soluble vitamins, certain aromatic compounds, and long-chain alcohols and waxes.

In living organisms, lipids generally serve as the basis for cell membranes and as a form of fuel storage. Lipids can also be found conjugated with proteins or carbohydrates, such as in the form of lipoproteins and lipopolysaccharides.

Examples of vegetable oils that can be used in accordance with this invention include, but are not limited to rapeseed (canola) oil, soybean oil, coconut oil, sunflower oil, palm oil, palm kernel oil, peanut oil, linseed oil, tall oil, corn oil, castor oil, jatropha oil, jojoba oil, olive oil, flaxseed oil, camelina oil, safflower oil, babassu oil, tallow oil and rice bran oil.

Vegetable oils as referred to herein can also include processed vegetable oil material. Non-limiting examples of processed vegetable oil material include fatty acids fatty acid alkyl esters. Alkyl esters typically include $C_1$-$C_5$ alkyl esters. One or more of methyl, ethyl, and propyl esters are preferred.

Examples of animal fats that can be used in accordance with the invention include, but are not limited to, beef fat (tallow), hog fat (lard), turkey fat, fish fat/oil, and chicken fat. The animal fats can be obtained from any suitable source including restaurants and meat production facilities.

Animal fats as referred to herein also include processed animal fat material. Non-limiting examples of processed animal fat material include fatty acids and fatty acid alkyl esters. Alkyl esters typically include $C_1$-$C_5$ alkyl esters. One or more of methyl, ethyl, and propyl esters are preferred.

Algae oils or lipids are typically contained in algae in the form of membrane components, storage products, and metabolites. Certain algal strains, particularly microalgae such as diatoms and cyanobacteria, contain proportionally high levels of lipids. Algal sources for the algae oils can contain varying amounts, e.g., from 2 wt % to 40 wt % of lipids, based on total weight of the biomass itself.

Algal sources for algae oils include, but are not limited to, unicellular and multicellular algae. Examples of such algae include a rhodophyte, chlorophyte, heterokontophyte, tribophyte, glaucophyte, chlorarachniophyte, euglenoid, haptophyte, cryptomonad, dinoflagellum, phytoplankton, and the like, and combinations thereof. In one embodiment, algae can be of the classes Chlorophyceae and/or Haptophyta. Specific species can include, but are not limited to, *Neochloris oleoabundans, Scenedesmus dimorphus, Euglena gracilis, Phaeodactylum tricornutum, Pleurochrysis carterae, Prymnesium parvum, Tetraselmis chui*, and *Chlamydomonas reinhardtii*.

The lipid material portion of the feedstock, when present, can be comprised of triglycerides, fatty acid alkyl esters, or preferably combinations thereof. In one embodiment where lipid material is present, the feedstock can include at least 0.05 wt % lipid material, based on total weight of the feedstock provided for processing into fuel, preferably at least 0.5 wt %, for example at least 1 wt %, at least 2 wt %, or at least 4 wt %. Additionally or alternately where lipid material is present, the feedstock can include not more than 40 wt % lipid material, based on total weight of the feedstock, preferably not more than 30 wt %, for example not more than 20 wt % or not more than 10 wt %.

In embodiments where lipid material is present, the feedstock can include not greater than 99.9 wt % mineral oil, for example not greater than 99.8 wt %, not greater than 99.7 wt %, not greater than 99.5 wt %, not greater than 99 wt %, not greater than 98 wt %, not greater than 97 wt %, not greater than 95 wt %, not greater than 90 wt %, not greater than 85 wt % mineral oil, or not greater than 80 wt %, based on total weight of the feedstock. Additionally or alternately in embodiments where lipid material is present, the feedstock can include at least 50 wt % mineral oil, for example at least 60 wt %, at least 70 wt %, at least 75 wt %, or at least 80 wt % mineral oil, based on total weight of the feedstock.

In some embodiments where lipid material is present, the lipid material can comprise a fatty acid alkyl ester, such as, but not limited to, fatty acid methyl esters (FAME), fatty acid ethyl esters (FAEE), and/or fatty acid propyl esters.

Additionally or alternately, the present invention can include one or more of the following embodiments.

Embodiment 1

A method for making a low sulfur marine and/or bunker fuel composition with a reduced concentration of components that have been cracked, the method comprising: contacting a gasoil feed stream having at least 2000 wppm, for example at least 7500 wppm, sulfur content with a hydrogen-containing gas in the presence of a hydrotreating catalyst under effective hydrotreating conditions in a catalytic feed hydrotreater, such that the product exhibits at most 5000 wppm, for example at most 1000 wppm, sulfur content, a pour point of at least 7° C., and a kinematic viscosity of at least 12 cSt at about 50° C., without the product being subject to cracking; optionally blending at least a portion of the uncracked product with 0-70 vol % of other components, selected from viscosity modifiers, pour point depressants, lubricity modifiers, antioxidants, and combinations thereof, to form a marine and/or bunker fuel composition, the resulting marine and/or bunker fuel composition containing the uncracked product having: at most 5000 wppm, for example at most 1000 wppm, sulfur content; at most 25 vol %, based on all components of the marine and/or bunker fuel composition, of residual components selected from crude fractionation vacuum resid, crude fractionation atmospheric resid, visbreaker resid, deasphalted vacuum resid, slurry oil, and combinations thereof; less than 50 vol %, based on all components of the marine and/or bunker fuel composition, of residual components, components subject to a refinery cracking step, or both; and at least one of a kinematic viscosity at about 50° C. from 12 cSt to 50 cSt, a density at about 15° C. from 0.90 g/cm$^3$ to 0.94 g/cm$^3$, a pour point from 7° C. to 45° C., and a calculated carbon aromaticity index of 850 or less.

Embodiment 2

A low sulfur marine and/or bunker fuel composition comprising: 30 vol % to 100 vol % of an uncracked, hydrotreated gasoil product having at most 1000 wppm sulfur content, a pour point of at least 5° C., and a kinematic viscosity of at least 15 cSt at about 50° C.; and up to 70 vol % of other components, selected from viscosity modifiers, pour point depressants, lubricity modifiers, antioxidants, and combinations thereof, wherein the low sulfur marine and/or bunker fuel composition has: at most 1000 wppm sulfur content; at most 25 vol %, based on all components of the marine and/or bunker fuel composition, of residual components selected from crude fractionation vacuum resid, crude fractionation atmospheric resid, visbreaker resid, deasphalted vacuum resid, slurry oil, and combinations thereof; less than 50 vol %, based on all components of the marine and/or bunker fuel composition, of residual components, components subject to a refinery cracking step, or both; and at least one of a kinematic viscosity at about 50° C. from 12 cSt to 50 cSt, a density at about 15° C. from 0.90 g/cm$^3$ to 0.94 g/cm$^3$, a pour point from 7° C. to 45° C., and a calculated carbon aromaticity index of 850 or less.

Embodiment 3

The method of embodiment 1, wherein the gasoil feed stream is a vacuum gasoil having a sulfur content of at least 1 wt %.

Embodiment 4

The method or composition of any of the previous embodiments, wherein the uncracked, hydrotreated gasoil product exhibits a sulfur content of at most 600 wppm, a pour point of at most 30° C., and/or a kinematic viscosity of at most 50 cSt at about 50° C.

Embodiment 5

The method or composition of any of the previous embodiments, wherein the marine and/or bunker fuel composition has a sulfur content between 900 wppm and 1000 wppm.

Embodiment 6

The method or composition of any of the previous embodiments, wherein the marine and/or bunker fuel composition comprises at most 30 vol %, based on all components of the marine and/or bunker fuel composition, of components subject to a refinery cracking step, and/or at most 10 vol % of residual components, based on all components of the marine and/or bunker fuel composition.

Embodiment 7

The method or composition of any of the previous embodiments, wherein the blending results in the marine and/or bunker fuel composition comprising from 40 vol % to 100 vol % of the uncracked, hydrotreated gasoil product.

Embodiment 8

The method or composition of any of the previous embodiments, wherein the blending results in the marine and/or bunker fuel composition comprising from 80 vol % to 100 vol % of the uncracked, hydrotreated gasoil product.

Embodiment 9

The method or composition of any of the previous embodiments, wherein the blending results in the marine and/or bunker fuel composition comprising from 85 vol % to 99.99 vol % of the uncracked, hydrotreated gasoil product.

Embodiment 10

The method or composition of any of the previous embodiments, wherein the resulting marine and/or bunker fuel composition comprises up to 15 vol % of slurry oil, fractionated crude oil, or a combination thereof.

Embodiment 11

The method or composition of any of the previous embodiments, wherein the marine and/or bunker fuel composition exhibits one or more of the following: a flash point of at least 60° C.; a hydrogen sulfide content of at most 2.0 mg/kg; an acid number of at most 0.5 mg KOH per gram; a sediment content of at most 0.1 wt %; a water content of at most 0.3 vol %; and an ash content of at most 0.01 wt %.

EXAMPLES

Example 1

In prophetic Example 1, a vacuum gasoil, having been fractionated from a crude oil and exhibiting the properties disclosed in Table 1 below, is provided to a (cat feed) hydrotreating unit that is loaded with a commercially available alumina-supported Group VIB/Group VIII (e.g., NiMo) hydrotreating catalyst. In the hydrotreating unit, the vacuum gasoil was both hydrotreated to remove most (e.g., at least 80% by weight, for example at least 90% by weight or at least 95% by weight) of the sulfur content (e.g., hydrotreating conditions included a WABT between about 315° C. and about 455° C., for example between about 375° C. and about 420° C., a total pressure from about 3.4 MPag to about 20.7 MPag, for example of about 5.0 MPag, a hydrogen partial pressure from about 2.1 MPag to about 20.7 MPag, a hydrogen treat gas rate from about 500 scf/bbl to about 5000 scf/bbl, for example of about 2000 scf/bbl, and an LHSV from about 0.2 hr$^{-1}$ to about 10 hr$^{-1}$, for example of about 0.5 hr$^{-1}$). The product from the hydrotreating unit is an uncracked, hydrotreated vacuum gasoil product (details in Table 2 below), prior to being fed to an FCC unit. At least a portion of this uncracked, hydrotreated vacuum gasoil product can be diverted from the FCC unit into a marine and/or bunker fuel composition, optionally including one or more other additives. At least 30% by volume, and up to 100% by volume, of the marine and/or bunker fuel composition can be comprised of this uncracked, hydrotreated vacuum gasoil product.

TABLE 1

| Typical (actual) untreated/virgin VGO feed | |
|---|---|
| Sulfur, wt % | ~0.8-2.5 (~1.8) |
| Nitrogen, wppm | ~800-1900 (~1280) |
| Density at ~15° C., g/cm$^3$ | ~0.90-0.95 (~0.924) |
| Conradson carbon residue, wt % | ~0.25-0.90 (~0.5) |
| Initial Boiling Point (IBP), ° C. | ~225-265 (~247) |
| T5 Boiling Point, ° C. | ~290-330 (~311) |
| T50 Boiling Point, ° C. | ~425-465 (~443) |
| T95 Boiling Point, ° C. | ~545-585 (~560) |
| Final Boiling Point (FBP), ° C. | ~590-635 (~608) |
| Nickel content, mg/kg | ~0.1-2 (~0.6) |
| Vanadium content, mg/kg | ~0.2-4 (~2.9) |

TABLE 2

| Uncracked, hydrotreated VGO Product | |
|---|---|
| Sulfur, wppm | 580 |
| Kinematic Viscosity @ ~50° C., cSt | 35 |
| Kinematic Viscosity @ ~100° C., cSt | 7.1 |
| Pour Point, ° C. | 33° C. |
| Density at ~15° C., g/cm$^3$ | 0.902 |
| Water content, % (v/v) | 0.05 |
| Ash content at ~550° C., % (m/m) | <0.010 |
| Microcarbon residue, % (m/m) | <0.10 |
| Total sediment, % (m/m) | 0.01 |
| Flash Point, ° C. | >70 |
| CCAI | 797 |
| Lubricity, μm | 191 |
| Acid number, mg KOH/g | <0.01 |
| Silicon content, mg/kg | <1 |
| Aluminum content, mg/kg | <1 |
| Si + Al content, mg/kg | <2 |

Example 2

In prophetic Example 2, an uncracked, hydrotreated vacuum gasoil product, similar to that described in Example 1, can be combined with a (cracked) slurry oil to form a marine and/or bunker fuel composition. In this embodiment, the relative composition of the fuel composition can be about 88 vol % of the uncracked, hydrotreated vacuum gasoil product and about 12 vol % of the slurry oil. The individual characteristics of each component, as well as of the resulting marine and/or bunker fuel composition, are shown below in Table 3.

TABLE 3

| Characteristic | VGO Product | Slurry Oil | ~88/12 v/v Mixture |
|---|---|---|---|
| Density @ ~15° C., g/cc | 0.902 | 1.03 | 0.917 |
| Sulfur, wppm | 580 | ~3500 | ~930 |
| Kinematic Viscosity @ ~50° C., cSt | 35 | 60 | 37 |
| Pour Point, ° C. | 33 | 15 | ~31 |
| Si + Al content, mg/kg | ~0 | ~500 | ~60 |

Example 3

In prophetic Example 3, an uncracked, hydrotreated vacuum gasoil product, similar to that described in Example 1, can be combined with a side draw off of a crude oil fractionator, e.g., an uncracked composition having roughly a kerosene, jet, and/or diesel boiling range (such as having a T1 from about 360° F. to about 420° F. or of about 390° F. and a T99 from about 770° F. to about 880° F. or of about 805° F., and/or having a T10 from about 520° F. to about 640° F. or of about 580° F. and a T90 from about 690° F. to about 830° F. or of about 760° F., in certain cases also un-hydrotreated), to form a marine and/or bunker fuel composition. In this embodiment, the relative composition of the fuel composition can be about 93 vol % of the uncracked, hydrotreated vacuum gasoil product and about 7 vol % of the crude oil fraction. The resulting fuel composition can have at least a 5° C. lower, and preferably at least a 10° C. lower, pour point than the 100% uncracked, hydrotreated vacuum gasoil product alone (e.g., from Example 1). The resulting fuel composition may optionally also have at least a 3 cSt lower (e.g., at least a 5 cSt lower) kinematic viscosity (as measured at about 50° C.) and/or at least a 0.005 g/cm$^3$ lower (e.g., at least a 0.008 g/cm$^3$ lower) density (as measured at about 15° C.).

Example 4

In prophetic Example 4, an uncracked, hydrotreated vacuum gasoil product, similar to that described in Example 1, can be combined with the bottoms from an FCC unit to form a marine and/or bunker fuel composition. In this embodiment, the relative composition of the fuel composition can be about 90 vol % of the uncracked, hydrotreated vacuum gasoil product and about 10 vol % of the (cracked) FCC bottoms. The resulting fuel composition can have at least a 3° C. lower, and preferably at least a 5° C. lower (e.g., at least a 10° C. lower), pour point than the 100% uncracked, hydrotreated vacuum gasoil product alone (e.g., from Example 1).

Example 5

In Example 5, three samples of uncracked, hydrotreated vacuum gasoil product (identified as A, B, and C), each relatively similar to that described in Example 1 and each having a pour point of about 39° C., were combined with a pour point depressant (PPD) to form a marine and/or bunker fuel composition. In this embodiment, the relative composition of the fuel composition was ~99+ vol % of the uncracked, hydrotreated vacuum gasoil product and from about 250 wppm to about 5000 wppm of Infineum R185 PPD.

Considering uncracked, hydrotreated vacuum gasoil product A, three different contents of the PPD were added as follows, based on the total weight of the marine/bunker fuel—about 250 wppm (identified as A1), about 1000 wppm (identified as A2), and about 5000 wppm (identified as A3), which resulted in pour points for the resulting marine/bunker fuels of about 18° C. (A1), about 12° C. (A2), and about 9° C. (A3). Considering uncracked, hydrotreated vacuum gasoil product B, about 1000 wppm of the PPD was added, based on the total weight of the marine/bunker fuel, which resulted in a pour point for the resulting marine/bunker fuel of about 12° C. Considering uncracked, hydrotreated vacuum gasoil product C, about 1000 wppm of the PPD was added, based on the total weight of the marine/bunker fuel, which resulted in a pour point for the resulting marine/bunker fuel of about 9° C.

Example 6

In Example 6, several samples of uncracked, hydrotreated vacuum gasoil product (abbreviated "product" in this Example), similar to that described in Example 1, were combined with a heavy cycle oil (FCC distillate) to form a marine and/or bunker fuel composition. In this embodiment, the relative composition of the resultant fuel ranged from 100 vol % to about 70 vol % of the product and from 0 vol % to about 30 vol % of the heavy cycle oil (HCO). The individual characteristics of the pure product and the pure HCO, as well as mixtures thereof (Samples 6A-D representing marine and/or bunker fuel compositions according to the invention), are shown below in Table 4.

TABLE 4

| Sample | wt % product | wt % HCO | Kinetic Viscosity @ 50° C. (cSt) | Pour Point (° C.) | Density @ 15° C. (g/cm$^3$) |
|---|---|---|---|---|---|
| 6A | 100 | 0 | ~25 | ~ 36 | ~0.900 |
| 6B | ~90 | ~10 | ~20 | ~ 36 | ~0.905 |
| 6C | ~80 | ~20 | ~15 | ~ 33 | ~0.910 |
| 6D | ~70 | ~30 | ~12 | ~ 30 | ~0.915 |
| Pure HCO | 0 | 100 | ~3 | ~ −9 | ~0.930 |

The principles and modes of operation of this invention have been described above with reference to various exemplary/preferred embodiments. As understood by those of skill in the art, the overall invention, defined by the claims, can encompass other preferred embodiments not specifically enumerated herein.

What is claimed is:

1. A low sulfur marine and/or bunker fuel composition comprising:

30 vol % to 100 vol % of an uncracked, hydrotreated gasoil product having at most 5000 wppm sulfur content, a pour point of at least 7° C., a T5 boiling point of at least 280° C., a T50 boiling point of at least 400° C., and a kinematic viscosity of at least 12 cSt at about 50° C.; and up to 70 vol % of other components, selected from viscosity modifiers, pour point depressants, lubricity modifiers, antioxidants, and combinations thereof, wherein the low sulfur marine and/or bunker fuel composition has:

at most 5000 wppm sulfur content;

at most 25 vol %, based on all components of the marine and/or bunker fuel composition, of residual components selected from crude fractionation vacuum resid, deasphalted vacuum resid, slurry oil, and combinations thereof;

less than 50 vol %, based on all components of the marine and/or bunker fuel composition, of residual components, components subject to a refinery cracking step, or both; and at least one of a kinematic viscosity at about 50° C. from 12 cSt to 50 cSt, a density at about 15° C. from 0.90 g/cm$^3$ to 0.94 g/cm$^3$, a pour point from 7° C. to 45° C., and a calculated carbon aromaticity index of 850 or less.

2. The low sulfur marine and/or bunker fuel composition according to claim 1, wherein the uncracked, hydrotreated gasoil product exhibits a sulfur content of at most 600 wppm, a pour point of at most 30° C., and/or a kinematic viscosity of at most 50 cSt at about 50° C.

3. The low sulfur marine- and/or bunker fuel composition according to claim 1, wherein the sulfur content is between 900 wppm and 1000 wppm.

4. The low sulfur marine and/or bunker fuel composition according to claim 1, comprising at most 30 vol %, based on all components of the low sulfur marine and/or bunker fuel composition, of components subject to a refinery cracking step, and/or at most 10 vol % of residual components, based on all components of the low sulfur marine and/or bunker fuel composition.

5. The low sulfur marine and/or bunker fuel composition according to claim 1, wherein the uncracked, hydrotreated gasoil product comprises from 80 vol % to 100 vol % of the composition.

6. The low sulfur marine and/or bunker fuel composition according to claim 1, wherein the uncracked, hydrotreated gasoil product comprises from 85 vol % to 99.99 vol % of the composition.

7. The low sulfur marine and/or bunker fuel composition according to claim 1, wherein the uncracked, hydrotreated gasoil product comprises up to 15 vol % of slurry oil, fractionated crude oil, or a combination thereof.

8. The low sulfur marine and/or bunker fuel composition according to claim 1, which exhibits one or more of the following: a flash point of at least 60° C.; a hydrogen sulfide content of at most 2.0 mg/kg; an acid number of at most 0.5 mg KOH per gram; a sediment content of at most 0.1 wt %; a water content of at most 0.3 vol %; and an ash content of at most 0.01 wt %.

9. The low sulfur marine and/or bunker fuel composition according to claim 1, wherein the uncracked, hydrotreated gasoil product has a T5 boiling point of at least 290° C. and a T50 boiling point of at least 425° C.

10. The low sulfur marine and/or bunker fuel composition according to claim 1, wherein the uncracked, hydrotreated gasoil product has an IBP of at least 230° C., a T95 boiling point of at least 510° C., and an FBP of at least 560° C.

11. The low sulfur marine and/or bunker fuel composition according to claim 1, wherein the uncracked, hydrotreated gasoil product has an IBP of at least 235° C., a T95 boiling point of at least 545° C., and an FBP of at least 590° C.

12. The low sulfur marine and/or bunker fuel composition according to claim 9, wherein the uncracked, hydrotreated gasoil product has an IBP of at least 235° C., a T95 boiling point of at least 545° C., and an FBP of at least 590° C.

* * * * *